US005999083A

United States Patent [19]

Kordecki

[11] Patent Number: 5,999,083

[45] Date of Patent: Dec. 7, 1999

[54] RESISTIVE CONTROLLER USING MAGNETIC REPULSION

[75] Inventor: David L. Kordecki, Elkhart, Ind.

[73] Assignee: CTS Corporation, Elkhart, Ind.

[21] Appl. No.: 09/299,361

[22] Filed: Apr. 26, 1999

[51] Int. Cl.[6] ..... H01C 10/10

[52] U.S. Cl. ..... 338/47; 338/99; 338/113; 338/114

[58] Field of Search ..... 338/12, 47, 99, 338/101, 113, 114

[56] References Cited

U.S. PATENT DOCUMENTS

| | | | |
|---|---|---|---|
| 3,968,467 | 7/1976 | Lampen et al. . | |
| 4,494,105 | 1/1985 | House . | |
| 4,503,705 | 3/1985 | Polchaninoff | 73/172 |
| 4,532,395 | 7/1985 | Zukowski . | |
| 5,079,536 | 1/1992 | Chapman | 338/99 |
| 5,208,576 | 5/1993 | Wunderlich et al. | 338/248 |
| 5,228,562 | 7/1993 | Burk . | |
| 5,241,308 | 8/1993 | Young . | |
| 5,876,106 | 3/1999 | Kordecki . | |

*Primary Examiner*—Lincoln Donovan
*Assistant Examiner*—Richard K. Lee
*Attorney, Agent, or Firm*—Mark P. Bourgeois

[57] ABSTRACT

A membrane potentiometer that uses magnets to keep the membranes separated. A controller has a backplate and a cover that has sidewalls and a top wall which has a central opening defining a cavity. The cover mounts to the backplate. A pair of membrane potentiometer are interposed between the cover and the backplate to receive a first voltage, and output a second voltage that is a percentage of the first voltage. A pair of magnet assemblies are located on outer surfaces of the membrane potentiometer to generate a magnetic repulsion force to keep the membrane potentiometer separated from each other.

15 Claims, 2 Drawing Sheets

RESISTIVE CONTROLLER USING MAGNETIC REPULSION

BACKGROUND OF THE INVENTION

1. FIELD OF THE INVENTION

This invention relates to a resistive controller, and more specifically to a membrane potentiometer, for use as a light dimmer or other voltage controlling device, that uses magnets to keep the membranes separated.

2. DESCRIPTION OF THE RELATED ART

Potentiometers are well known for controlling voltage selection in numerous types of applications in both home and industry. For example, these devices may be used in the control panels of such things as aircraft and aerospace applications, computers, arcade games, kitchen appliances, or lighting systems to name a few.

In the past, prior art Potentiometers for providing voltage selection have typically been operated using a mechanical wiper that is typically controlled by a knob or slider on a control panel. The wiper contacts a resistive element, which provides for voltage selection over a continuous range of voltages. The constant mechanical contact between the wiper and the resistive element tends to accelerate the wear and eventual failure of this type of potentiometer.

A more recently devised potentiometer uses a membrane comprising a continuous length of electrically resistive material, a corresponding continuous length to of electrically conductive material, which serves as a wiper, and an electrically insulating spacer which serves to simultaneously support and separate the resistive and conductive layers. Either one or both of the resistive and conductive materials are designed as flexible members so that they can be pressed together at any selected location along their length to bring them into electrical contact.

If a voltage is applied across the resistive material, a voltage gradient is established along the length of the material. Thus, touching either the top or bottom surface of the flexible member will cause the resistive and conductive materials to contact each other, producing a voltage output on the conductive material or wiper. The advantage of this device is that it minimizes wiper contact and reduces wear and yet provides a continuous range of output voltage levels.

A potentiometer membrane as described can be used to make a reliable and economical dimmer and/or switch for use with a light fixture. However, the flexible members must be kept separate, to prevent false readings, particularly in the middle of the member. In order to accomplish this, dielectric bumps are added to the member to keep portions of the member from sagging and touching each other. This problem becomes worse when the membrane potentiometer is desired to have a large area. Unfortunately, these dielectric bumps also cause portions of the resistors to become insulated which causes the output voltage from the resistor to have a nonlinear behavior which is undesirable.

It is desirable to have a large surface area membrane potentiometer with a linear output.

3. RELATED ART

Examples of patents that are related to the present invention are as follows, and each patent is herein incorporated by reference for the supporting teachings:

U.S. Pat. No. 5,876,106 is an illuminated controller.

U.S. Pat. No. 5,241,308 is a force sensitive touch panel.

U.S. Pat. No. 5,228,562 is a membrane switch and fabrication method.

U.S. Pat. No. 4,494,105 is a touch controlled circuit apparatus for voltage selection.

U.S. Pat. No. 4,532,395 is a flexible touch switch plate.

U.S. Pat. No. 3,968,467 is a touch controlled voltage-divider device.

The foregoing patents reflect the state of the art of which the applicant is aware and are tendered with the view toward discharging applicant's acknowledged duty of candor in disclosing information which may be pertinent in the examination of this application. It is respectfully stipulated, however, that none of these patents teach or render obvious, singly or when considered in combination, applicant's claimed invention.

SUMMARY OF THE INVENTION

It is a feature of the invention to provide a membrane potentiometer that uses magnets to keep the membranes separated.

An additional feature of the invention is to provide a controller for receiving a first voltage and outputting a second voltage that includes a backplate and a cover that has sidewalls and a top wall which has a central opening defining a cavity. The cover mounts to the backplate. A pair of membrane potentiometers are interposed between the cover and the backplate for receiving a first voltage, and outputting a second voltage that is a percentage of the first voltage. A pair of magnet assemblies are located on outer surfaces of the membrane potentiometer to generate a magnetic repulsion force to keep the first and second membrane potentiometer separated from each other.

The invention resides not in any one of these features per se, but rather in the particular combination of all of them herein disclosed and claimed and it is distinguished from the prior art in this particular combination of all of its structures for the functions specified. Other features of the present invention will become more clear from the following detailed description of the invention, taken in conjunction with the accompanying drawings and claims, or may be learned by the practice of the invention.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Figure 1:
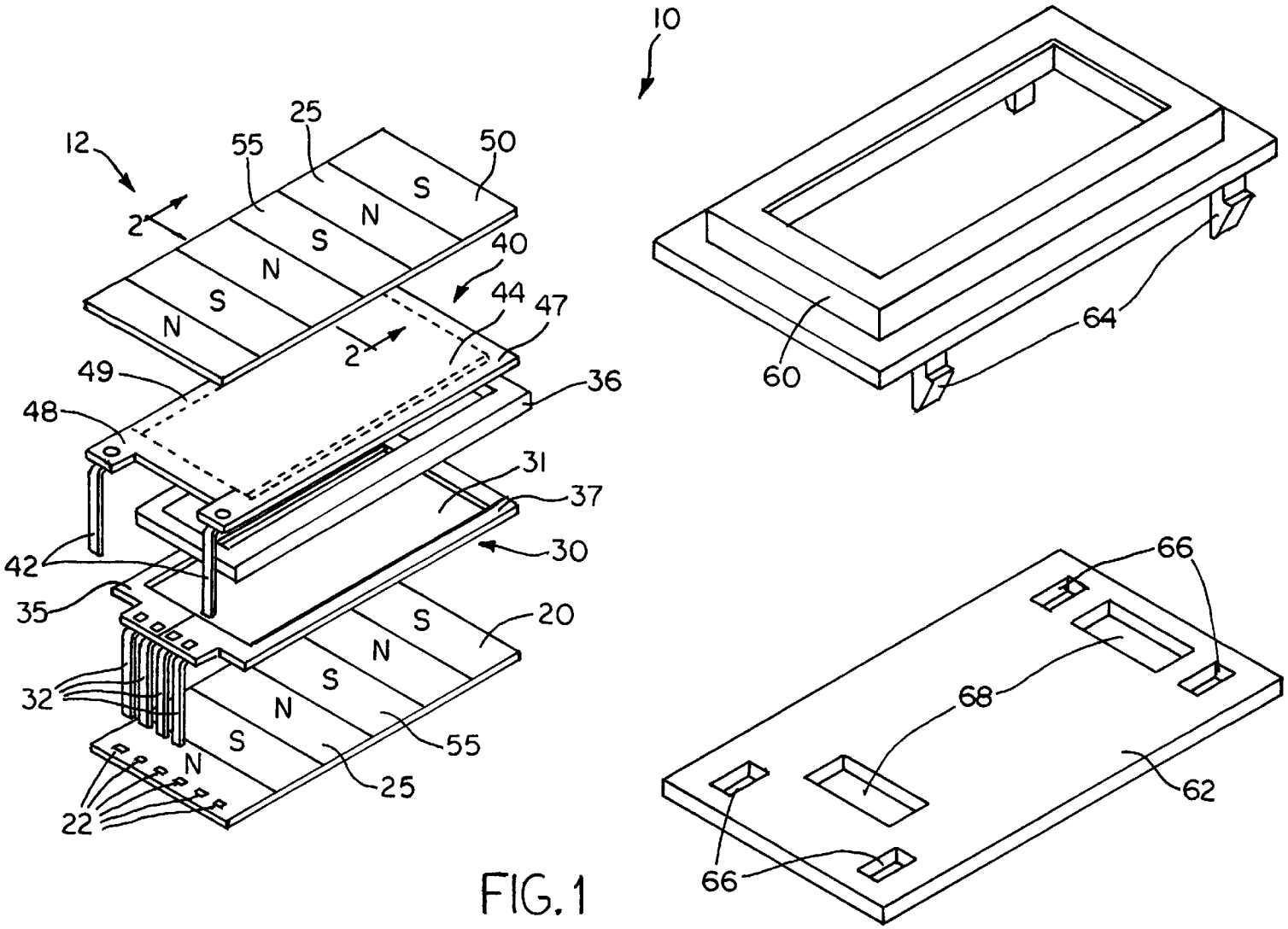
FIG. 1 is an exploded perspective view of the preferred embodiment of a resistive controller using repulsion.

It is noted that the drawings of the invention are not to scale. The drawings are merely schematic representations, not intended to portray specific parameters of the invention. The drawings are intended to depict only typical embodiments of the invention, and therefore should not be considered as limiting the scope of the invention. The invention will be described with additional specificity and detail through the use of the accompanying drawings. In the drawings, like numbering represent like elements between the drawings.

DETAILED DESCRIPTION OF THE PREFERRED EMBODIMENT

Figure 2:
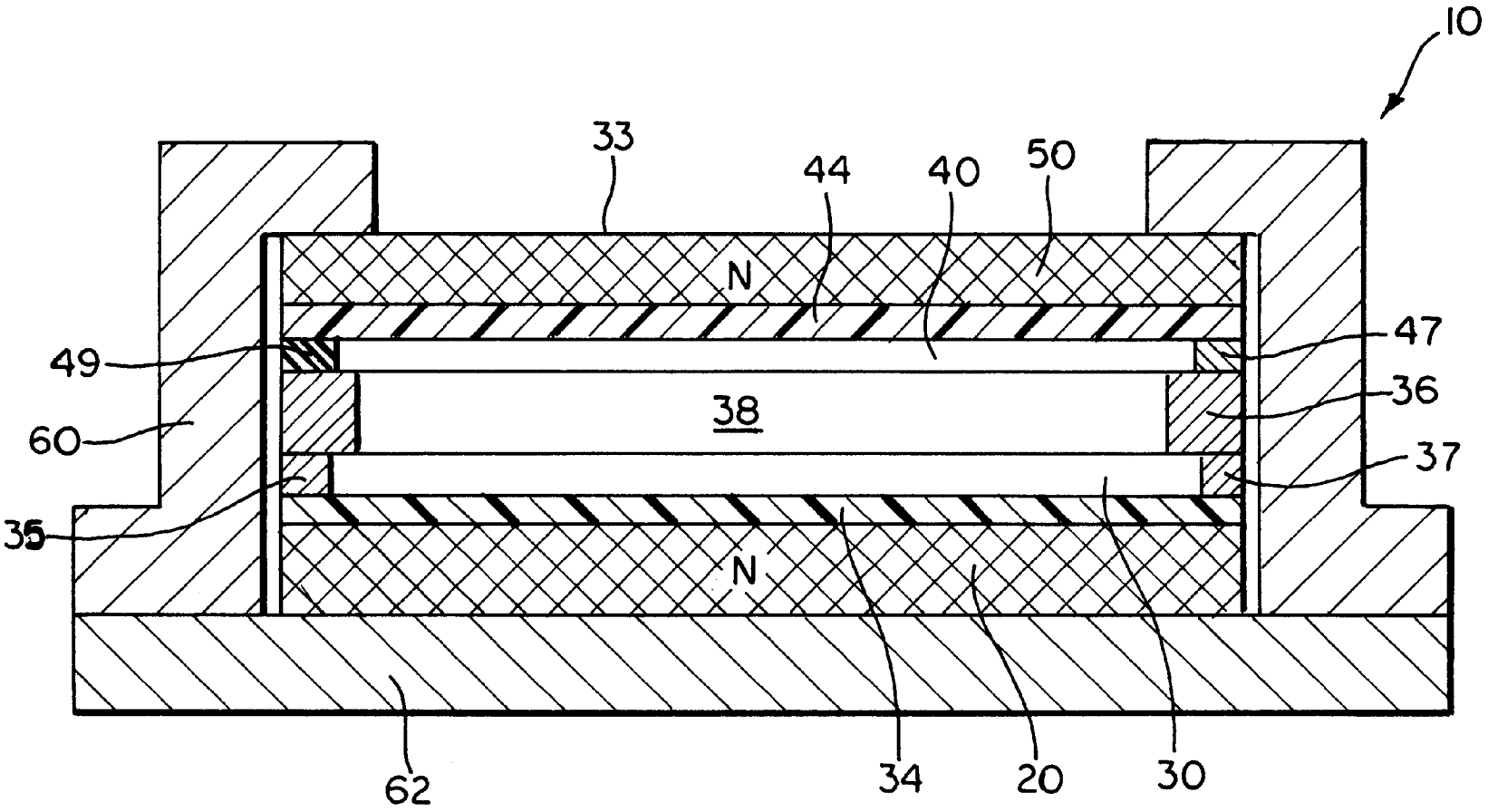
FIG. 2 is a cross sectional view of FIG. 1 taken along section line 2—2.

Referring to FIGS. 1 and 2, there is a membrane resistive controller 10 having a backplate 62 and a cover 60. Interposed between backplate 62 and cover 60 is a layered structure 12. Layered structure 12 includes a lower magnet assembly 20, a lower membrane potentiometer 30, an upper membrane potentiometer 40 and an upper magnet assembly 50. Magnet assemblies 20 and 50 are conventional polymer magnets and are made up of sections of alternating polarities. Magnets 20 and 50 are bonded to potentiometer 30 and 40 by an adhesive. The north polarized magnets 25 and the south polarized magnets 55 can be individual magnets or can be one magnet that is polarized in sections. Controller 10 is held together by locking tabs 64 which releasably locks into holes 66.

Membrane potentiometers 30 and 40 are conventional membrane potentiometers made of screen printed resistors and conductors on a Mylar film. Membrane potentiometer 30 has a Mylar film 34, resistor 31 and conductors 35 and 37 located on two lengthwise sides of potentiometer 30. A voltage would be placed on one of conductors 35 or 37 and the resulting voltage would be read on the other conductor. Similarly, membrane potentiometer 40 has a Mylar film 44, resistor 41 and conductors 47 and 48 located on ends of potentiometer 40. The resistor electrically connects to the conductors. An insulator 49 is located on a side of membrane potentiometer 40. A voltage would be placed on one of conductors 35, 37 or 47, 48 and the resulting voltage would be read on the conductor on the opposite side. Membrane potentiometers 30 and 40 have electrical connectors 32 and 42, respectively. Connectors 32 are connected to conductors 35 and 37. Connectors 42 are electrically connected to conductors 48 and 47. Connectors 42 are designed to fit on either side of aligned connectors 32 when layered structure 12 is assembled. Furthermore, connectors 32 and 42 are designed to be inserted through holes 22 and slot 68. The connectors can then be connected to a circuit board (not shown) having electronics (not shown) which are well known in the art. Membrane potentiometer 30 and 40 are separated by a dielectric spacer 36, thereby forming air space 38. Membrane potentiometer 30 has a top surface 33 that is depressed by the finger of a user during use.

Electrical operation of the controller is accomplished by multiplexing a voltage between the resistors as is well known in the art. When one of the resistors has an applied voltage, the other resistor acts as the collector. The output voltage is fed to a sample and hold circuit for further processing.

Remarks About the Preferred Embodiment

This design offers an advantage over the prior art in that magnetic assemblies 20 and 50 keep the inner surfaces of potentiometer 30 and 40 separated by the magnetic repulsion forces generated by like polarity magnets being aligned opposite each other. Furthermore, the invention provides a more linear electrical output signal during depression of the membrane potentiometer because the dielectric dimples are eliminated which cause a non-linear output signal. The magnetic spacers are used when the span across the spacer is large and allows the membrane to sag. The invention provides a reliable and cost effective design to accomplish the foregoing. The controller receives a first voltage and outputs a second voltage, which is a fraction or percentage of the first voltage. Typically, the voltage is adjusted by a user pressing a finger against surface 33. This causes the potentiometers to touch, at the point pressed. Accordingly, the electronics (not shown) will detect the change of resistance in the circuit and adjust the voltage to the device to be controlled. If desired a transparent sheet can be added over magnet assembly 50 to provide an additional layer of electrical insulation to protect the user from electrical contact.

Variations of the Preferred Embodiment

Although the illustrated embodiments display specific designs of the shape of controller 10, one skilled in the art will realize that the preferred embodiment would work with most any shape. For example, the controller could be round, oval or triangular without departing from the disclosed structure.

Connectors 32 and 42 can also be varied from the pins shown in the preferred embodiments. Any type of electrical connection known in the art could be used without departing from the scope of the invention. Also, the backplate 62 and cover 60 could be varied in innumerable ways. For example, screws could be used to secure the cover instead of the tabs depicted in FIG. 1. Backplate 62 and cover 60 could even be molded as a single unit.

Another alternative is to add an actuator such as a slide adjustment that would be moved by a user. The slide would be designed such that it will press resistors 30 and 40 together at the point where the slide is positioned.

If desired, the membrane potentiometers 30 and 40 could be screen printed directly onto the magnets 20 and 50.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States patent is:

1. A controller for receiving a first voltage and outputting a second voltage, comprising:

a) a first and second membrane potentiometer, located adjacent to each other, for receiving a first voltage, and outputting a second voltage that is a percentage of the first voltage; and b) a first and second magnet assembly, located on outer surfaces of the first and second membrane potentiometer, for generating a magnetic repulsion force to keep the first and second membrane potentiometer separated from each other.

2. The controller according to claim 1, further comprising:

a) a backplate; and b) a cover, having sidewalls and a top wall which has a central opening defining a cavity therein, for mounting on the backplate, the first and second membrane potentiometer, and the first and second magnet assembly interposed between the cover and the backplate.

3. The controller of claim 2, wherein a plurality of electrical terminations are connected to the first and second membrane potentiometer and extend through a slot in the backplate.

4. The controller of claim 1, wherein the first and second magnet assemblies each have a plurality of individual magnets with alternating polarities along the length of the first and second magnet assembly.

5. The controller of claim 4, wherein the individual magnets are disposed on the first and second magnet assemblies such that opposed individual magnets have like polarities.

6. A controller for receiving a first voltage and outputing a second voltage, comprising:

a) a backplate;

b) a cover, having sidewalls and a top wall which has a central opening defining a cavity therein, for mounting on the backplate;

c) a first and second membrane potentiometer, interposed between the cover and the backplate, for receiving a first voltage, and outputing a second voltage that is a percentage of the first voltage; and d) magnetic repulsion means, located on outer surfaces of the first and second membrane potentiometer and interposed between the cover and the backplate, for generating a magnetic repulsion force to keep the first and second membrane potentiometer separated from each other.

7. The controller of claim 6, wherein a plurality of electrical terminations are connected to the first and second membrane potentiometer and extend through a slot in the backplate.

8. The controller of claim 6, wherein the magnetic repulsion means is a first and second magnet assembly that each have a plurality of individual magnets with alternating polarities.

9. The controller of claim 8, where the individual magnets are disposed on the first and second magnet assemblies such that opposed individual magnets have like polarities.

10. A controller for receiving a first voltage and outputing a second voltage, comprising:

a) a first and second membrane potentiometer for receiving a first voltage, and outputing a second voltage that is a percentage of the first voltage; and b) a plurality of individual magnets having alternating polarities, located on outer surfaces of the first and second membrane potentiometers and interposed between the cover and the backplate, for generating a magnetic repulsion force to keep the first and second membrane potentiometer separated from each other.

11. The controller of claim 10, wherein a plurality of electrical terminations are connected to the first and second membrane potentiometers.

12. The controller of claim 10, where the individual magnets are disposed such that opposed individual magnets have like polarities.

13. The controller of claim 10, where the first and second membrane potentiometers are separated by a spacer located therebetween.

14. The controller according to claim 10, further comprising:

a) a backplate;

b) a cover, having sidewalls and a top wall which has a central opening defining a cavity therein, for mounting on the backplate, the first and second membrane potentiometers and the magnets interposed between the cover and the backplate.

15. A controller for receiving a first voltage and outputing a second voltage, comprising:

a) a first and second elongated magnet assembly including:

1) a plurality of individual magnets having alternating polarities along the length of the first and second magnet assemblies, wherein the individual magnets are disposed on the first and second magnet assemblies such that opposed individual magnets have like polarities; and b) a first and second potentiometer, disposed on inner surfaces of the first and second magnet assemblies, respectively and located adjacent each other, for receiving a first voltage, and outputing a second voltage that is a percentage of the first voltage, the magnet assemblies operable to generate a magnetic repulsion force that keeps the first and second membrane potentiometer separated from each other.

* * * * *